US005581817A

United States Patent [19]

Hicks

[11] Patent Number: 5,581,817

[45] Date of Patent: Dec. 10, 1996

[54] SPORTS SOCK

[76] Inventor: G. Timothy Hicks, 7110 Dennis Rd., Walnut Grove, N.C. 27052

[21] Appl. No.: 582,956

[22] Filed: Jan. 4, 1996

[51] Int. Cl.[6] ..... A41B 11/00; A41D 13/00

[52] U.S. Cl. ..... 2/239; 2/22; 2/242

[58] Field of Search ..... 2/22, 239, 240, 2/241, 242

[56] References Cited

U.S. PATENT DOCUMENTS

| | | | |
|---|---|---|---|
| 147,810 | 2/1874 | Baron | 2/242 X |
| 1,594,086 | 7/1926 | Arnold | 2/239 |
| 3,189,919 | 6/1965 | Chase | 2/22 X |
| 3,259,915 | 7/1966 | Dison . | |
| 3,510,882 | 5/1970 | White | 2/239 |
| 4,282,728 | 8/1981 | Tapp et al. | 2/239 X |
| 4,373,215 | 2/1983 | Guigley | 2/239 |
| 4,669,126 | 6/1987 | Jones | 2/22 |
| 5,157,791 | 10/1992 | Woodson et al. | 2/239 |
| 5,417,091 | 5/1995 | Moser | 2/239 X |
| 5,428,975 | 7/1995 | Lee, III | 66/178 |

*Primary Examiner*—John J. Calvert

[57] ABSTRACT

A sports sock for use while playing soccer or other activities includes a tubular elongated leg section having a cuff and an elastic top spaced from the cuff along said leg section and positioned interiorly thereof. A conventional foot portion is included in the preferred embodiment. The elongated leg section will allow the sock to be folded to sandwich a shin guard to protect the wearer's leg during play as the elastic top maintains the sock upright on the wearer's leg while the cuff grips the ankle area to contain the shin guard.

16 Claims, 2 Drawing Sheets

SPORTS SOCK

BACKGROUND OF THE INVENTION

1. Field of the Invention

The invention herein pertains to footwear and particularly to socks as are worn by athletes during soccer games.

2. Description of the Prior Art and Objectives of the Invention

With the growing numbers of adults and children participating in athletic contests such as soccer, basketball, baseball and other sports, it has become increasingly significant that injuries be prevented and/or at least minimized as possible. In sports which do not emphasize contact, such as soccer, basketball and others, protective equipment is needed to guard against inadvertent impact and injuries resulting therefrom. Soccer players are frequently struck along the shin areas of their legs during play which can result in cuts, bruises or even broken bones. To prevent such injuries, shin guards have been in use many years formed from rigid materials such as plastic or metal which are attached by the use of straps and other means to hold the guards in place on the players' legs during the rigors of the game. U.S. Pat. No. 4,669,126 demonstrates an early sock used for playing soccer which accommodates a shin guard. U.S. Pat. No. 5,157,791 demonstrates a sock having a compartment for containing articles and a cuff which folds over for locking purposes.

While such prior art devices have been useful, there has remained a need for a sock which will accommodate a shin guard and which will be both easy to use and relatively inexpensive to fabricate. Thus, the present invention was conceived and one of its objectives is to provide a sock for use by soccer players which will hold a shin guard securely in place during play and adds padding between the shin guard and leg of the player.

It is another objective of the present invention to provide a sock which includes a cuff and an elastic top spaced along a foldable leg section which will contain a shin guard.

It is a further objective of the present invention to present a soccer sock which can be easily placed on the leg of the wearer, so the shin guard can be properly positioned easily and quickly.

It is also an objective of the present invention to provide a sock which can be fabricated by circular knitting using conventional knitting equipment.

Various other objectives and advantages of the current invention will become apparent to those skilled in the art as a more detailed description thereof is set forth below.

SUMMARY OF THE INVENTION

The aforesaid and other objectives are realized by forming a sock by sewing or preferably knitting which includes an elongated leg section having upper and lower leg segments which in unfolded form, extends above the knee of the wearer. A cuff is attached at the top of the upper segment (which may be double-ply) of the leg section which contains elastic yarn to hold the cuff tightly against the wearer's leg. An elastic top is formed during knitting proximate the upper calf or knee area interiorly of the leg section between the upper and lower leg segments and spaced below the cuff. At the bottom of the lower leg segment of the tubular leg section, below the elastic top, a traditional foot portion is attached in one embodiment, which includes a reciprocated heel and toe as are standard in the trade.

In use, the wearer places his foot into the foot portion of the sock (of the preferred embodiment) and unfolds and extends the sock upwardly over his leg along the calf, knee, and thigh. With the sock so positioned on the wearer's leg, a shin guard is then placed against the shin area externally of the sock. The shin guard may be form-fitted for the shin and may include Velcro attachments, straps, or other means to help maintain it in place. Next, the cuff of the sock and upper leg segment is urged downwardly along the wearer's leg where it is folded over the shin guard and lower leg segment, allowing the elastic top to be exposed proximate the knee and allowing the cuff to gather and grip around the upper ankle area of the wearer. With the sock so folded and positioned, the shin guard is covered and is held in place between the lower leg segment of the sock between the ankle and knee by the folded upper leg segment of the sock.

In another embodiment of the invention, the sock is made without a foot portion and can be worn in conjunction with other socks of conventional manufacture. The socks of the invention can easily be manufactured on conventional hosiery circular knitting machines utilizing elastic yarn in the cuff and top areas and acrylic and nylon yarns, among others, in the leg section and foot portion as explained in more detail below.

DETAILED DESCRIPTION OF THE PREFERRED EMBODIMENT AND UTILIZATION OF THE INVENTION

Figure 2:
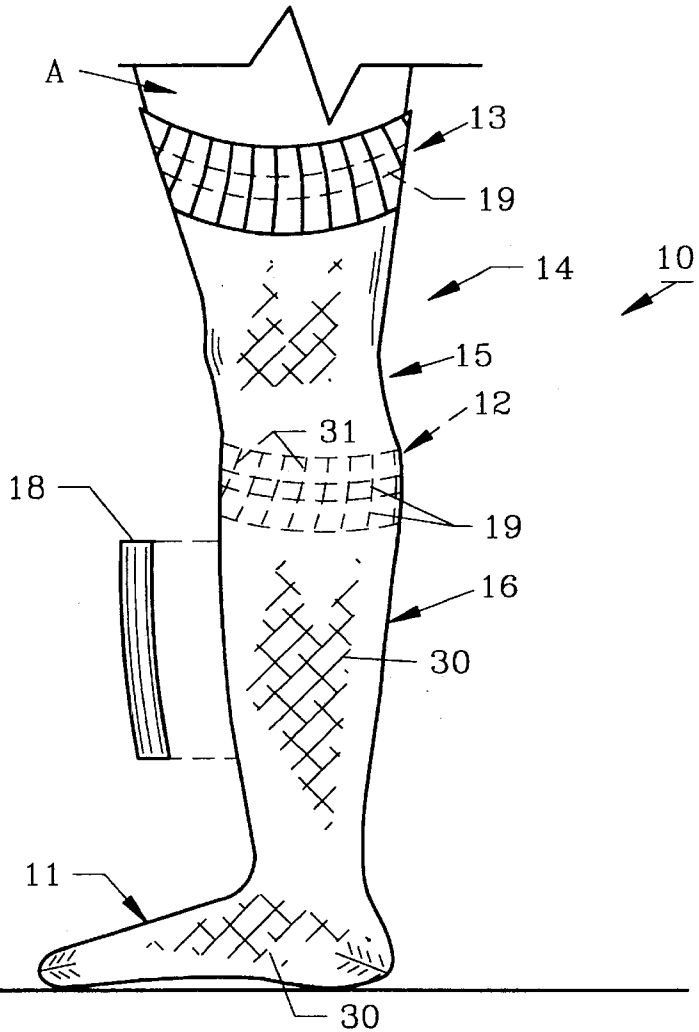
FIG. 2 shows the sock of FIG. 1 on the leg of the wearer before folding and placement of the shin guard.
Figure 1:
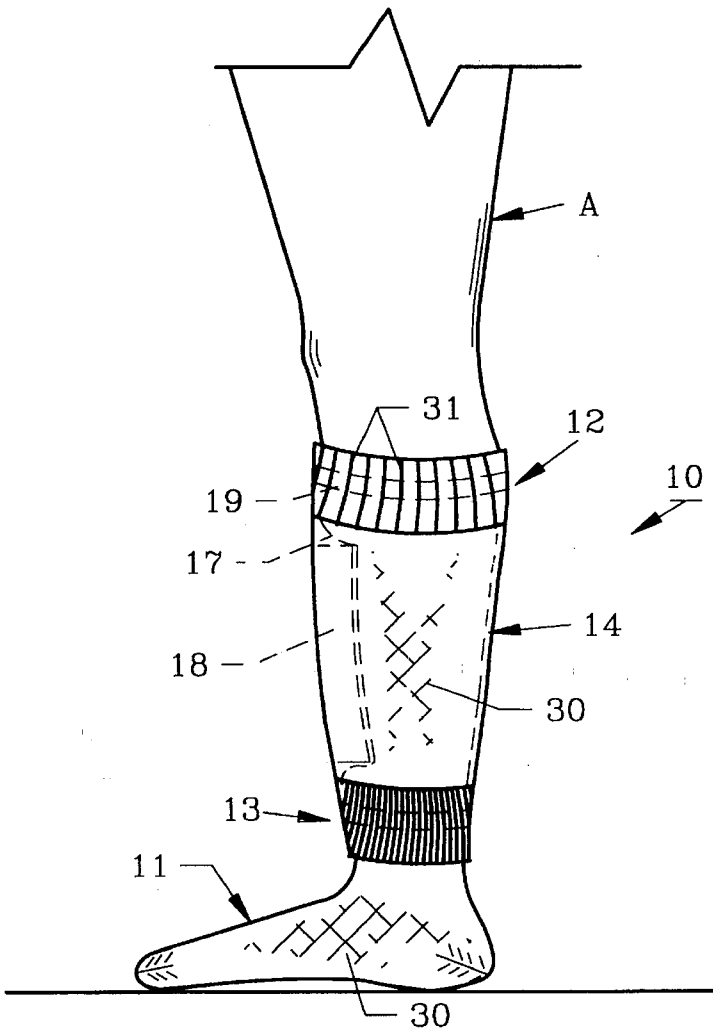
FIG. 1 demonstrates the preferred form of the invention in folded configuration as on the leg of the wearer containing a shin guard.

For a more complete understanding of the invention, turning now to the drawings, FIG. 1 shows the preferred form of the invention with sock 10 in a folded or rolled over configuration on leg A of a wearer. Sock 10 includes a conventional foot portion 11, a cuff 13, an elastic top 12 and an elongated leg section 14. Cuff 13 and elastic top 12 include elastic yarns 19 as are conventional in sock manufacturing. Leg section 14, as seen in FIG. 2, has an upper segment 15 formed of a double-ply and a lower segment 16, whereby upper segment 15 can be folded or rolled onto lower segment 16 to form a space or pocket 17 therebetween for containing standard shin guard 18 consisting of a rigid plastic member for protecting the wearer's leg from injury during play. Sock 10 can be made in a variety of ways such as by sewing or by circular knitting and while only one sock is seen, it would be understood that identical pairs of socks would be worn by the players. Circular knitting is the best mode of manufacture as will be hereinafter further explained.

Sock 10 as shown in FIGS. 1 and 2 is preferably produced utilizing a Crawford Concept Model 5 CVL circular knitting machine having a cylinder with a 5 inch diameter utilizing eighty-fourth needles. The preferred standard yarns are:

1 end×2/100 nylon 2 ends×2/29 acrylic 1 end×0935 elastic

Elastic rib top 12, as seen in FIG. 1, is knit utilizing a 1×1 elastic yarn 19 makeup as in a standard crew type sock with every other needle, for 4 courses. Then a mock rib top with 2/29 acrylic yarn (31) on every needle is run for 40 courses. The rib selection can be for example, 1×1, 3×1 or 2×2 as is standard in the trade. Next, 1 end of 2/100 nylon 30 and 2 ends of 2/29 acrylic using separate yarn fingers for each yarn are knit with the elastic yarn finger disengaged. This completes elastic rib top 12.

One end of the 2/29 acrylic yarn 31 goes onto the dial jacks for 1 course where leg segment 15 is flat-knit as is usual (see FIG. 2). This course is held by dial jacks until leg segment (15) is knit completely. Then 100 courses of 2 ends of 2/29 acrylic yarn 31 are knit to complete upper leg segment 15. Next cuff 13 is knit to upper leg segment 15 by introducing elastic yarn 19 for 40 courses.

Elastic yarn 19 is then terminated and 100 courses of flat knitting is run as before using the 2/29 acrylic yarn 31 to form the inside layer or ply of upper leg segment 15 as the dial jacks transfer acrylic yarn 31 back to the knitting needles. Lower leg segment 16 is then knit as a normal boot-type sock leg using one end of 2/100 nylon and one end of 2/29 acrylic yarn. Thereafter, foot portion 11 is knit having a heel and a toe as is conventional in the trade utilizing reciprocal knitting with nylon yarn 30 and acrylic yarn 31.

Figure 4:
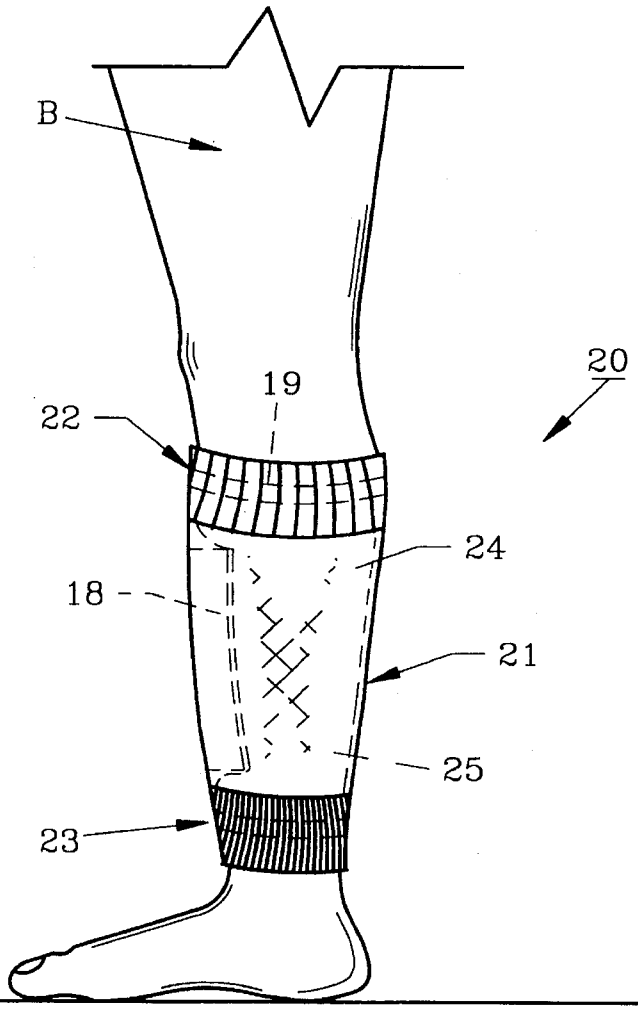
FIG. 4 illustrates the sock as seen in FIG. 3 in folded form as worn by a soccer player.
Figure 3:
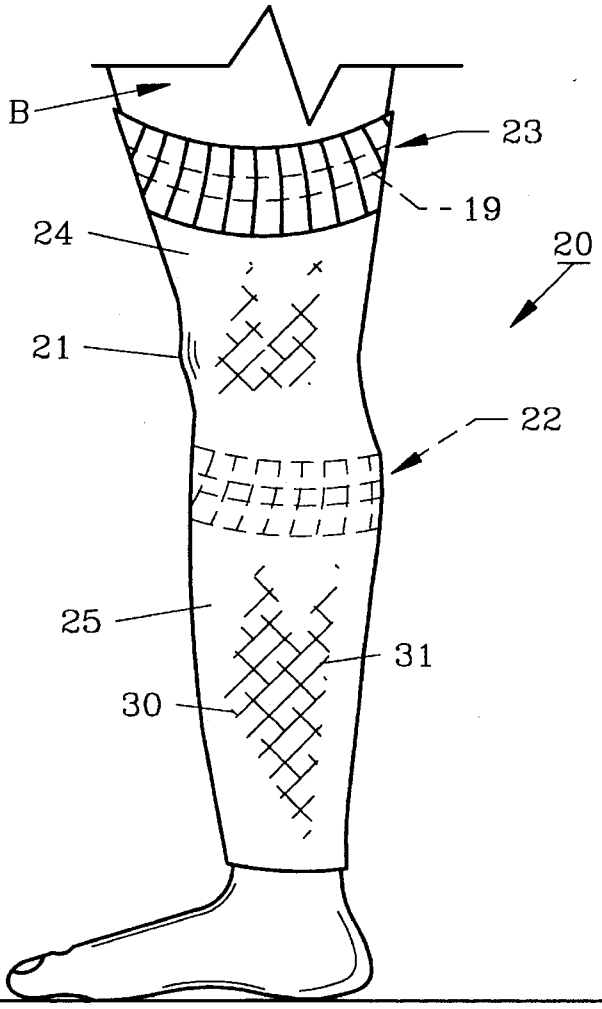
FIG. 3 depicts a second embodiment of the invention in unfolded fashion.

An alternate embodiment of the invention as seen in FIGS. 3 and 4 provides sock 20, which does not have a foot portion, unfolded along leg B, in FIG. 3 and includes leg section 21, elastic top 22 and cuff 23. Leg section 21 is composed of upper leg segment 24 and lower leg segment 25. Top 22 is positioned proximate the adjoinment of upper leg segment 24 to lower leg segment 25 and is interiorly disposed whereby, upon folding upper leg segment 24 onto lower leg segment 25 as shown in FIG. 4, top 22 is exposed at the top of leg section 21 to hold sock 20 upright on wearer's leg B.

Also, in FIG. 4, sock 20 is seen folded with cuff 23 positioned proximate the wearer's ankle and with sock 20 containing guard 18 between upper leg segment 24 and lower leg segment 25. Cuff 23 prevents guard 18 from slipping out during vigorous play activities while elastic top 22 maintains sock 20 properly upright on the wearer's leg. Both cuff 23 and elastic top 22 include elastic yarns 19 as are usual in the trade for sufficient stretch and gripping. Leg section 21 may be knitted from nylon yarn 30 and acrylic yarn 31 or other yarns as are standard in the trade.

The illustrations and examples provided herein are for explanatory purposes as those skilled in the art can vary the exact construction, sizes, yarn and production techniques without departing from the scope of the appended claims.

I claim:

1. A sock for initial placement on the leg of a wearer in an extended condition for subsequent downwardly folding upon itself, said sock in the extended condition comprising: a foot, an elongated leg section having an upper end, a cuff, said cuff joined to the upper end of said elongated leg section, a top, said top concealed within and joined to said elongated leg section below said cuff, wherein said top is exposed when the leg section is folded downwardly.

2. The sock of claim 1 wherein said cuff is knitted to said leg section.

3. The sock of claim 1 wherein said top is knitted to said leg section.

4. The sock of claim 1 wherein said top is positioned wholly interiorly of said leg section.

5. A sport sock for placement on the leg of the wearer in an extended condition for subsequent folding, said sock comprising: a cuff, a foldable elongated leg section, said cuff attached at one end of said foldable leg section, a top, said top attached to the interior of said leg section in spatial relation to said cuff, and a foot portion, said foot portion attached to said leg section at the end opposite said cuff, wherein said top is exposed when said leg section is folded downwardly upon itself.

6. The sport sock of claim 5 wherein said cuff comprises an elastic yarn.

7. The sport sock of claim 5 wherein said top comprises an elastic yarn.

8. The sport sock of claim 5 wherein said leg section has a length to extend over the knee of the wearer.

9. The sport sock of claim 5 formed by circular knitting.

10. The sport sock of claim 5 comprising nylon, acrylic and elastic yarns.

11. A sock comprising: an elongated tubular leg section, said leg section comprising an upper and a lower segment, said upper segment attached to said lower segment, a cuff, said cuff joined to the upper end of said upper segment a top, and said top interiorly joined to said leg section at the juncture of said upper and said lower segments, wherein said top is exposed when said upper segment is folded downwardly on said lower segment.

12. The sock of claim 11 when said cuff comprises an elastic yarn.

13. The sock of claim 11 when said top comprises an elastic yarn.

14. The sock of claim 11 when said foot portion comprises a heel and a toe.

15. The sock of claim 11 comprising nylon yarns.

16. The sock of claim 11 comprising acrylic yarns.

* * * * *